United States Patent [19]

Isobe

[11] Patent Number: 4,647,234

[45] Date of Patent: Mar. 3, 1987

[54] THERMAL PRINTER

[75] Inventor: Minoru Isobe, Tokyo, Japan

[73] Assignee: Oki Electric Industry Co., Ltd., Tokyo, Japan

[21] Appl. No.: 711,216

[22] Filed: Mar. 13, 1985

[30] Foreign Application Priority Data

Mar. 15, 1984 [JP] Japan ..... 59-48071

[51] Int. Cl.[4] ..... B41J 3/02

[52] U.S. Cl. ..... 400/120; 346/76 PH; 400/224.2; 400/240.3; 400/240.4; 400/622; 400/656; 400/621

[58] Field of Search ..... 400/120, 121, 240.3, 400/240.4, 224.2, 621, 88, 622, 656; 346/76 R, 76 L, 76 PH

[56] References Cited

U.S. PATENT DOCUMENTS

| | | | |
|---|---|---|---|
| 3,312,979 | 4/1967 | Torre et al. | 400/120 X |
| 3,814,227 | 6/1974 | Hurd, III et al. | 400/121 |
| 4,040,511 | 8/1977 | Beaven, Jr. et al. | 400/120 X |
| 4,112,531 | 9/1978 | Mitter | 400/121 X |
| 4,322,044 | 3/1982 | Bilek | 400/120 X |

FOREIGN PATENT DOCUMENTS

| | | | |
|---|---|---|---|
| 56-75877 | 6/1981 | Japan | 400/120 |
| 56-117675 | 9/1981 | Japan | 400/120 |
| 57-174276 | 10/1982 | Japan | 400/120 |
| 2037665 | 7/1980 | United Kingdom | 400/88 |

*Primary Examiner*—Edgar S. Burr
*Assistant Examiner*—Moshe I. Cohen
*Attorney, Agent, or Firm*—Wenderoth, Lind & Ponack

[57] ABSTRACT

A thermal printer includes a fixed planar thermal head composed of heating elements disposed in an area corresponding to one page, a detachable unitary ink donor ribbon assembly including a frame and an ink donor ribbon movably disposed in the frame and having a plurality of color zones, the ink donor ribbon being positioned in confronting relation to the planar thermal head, and a detachable unitary print paper storage assembly composed of a paper cartridge and print paper stored therein, and including a presser for holding the print paper in contact with the ink donor ribbon in a printing mode and for keeping the print paper out of contact with the ink donor ribbon in a non-printing mode. The planar thermal head and the print paper are prevented from relative movement in the printing mode until one-page printing is effected on the print paper. The print paper may comprise a stack of separate sheets or a roll of continuous print paper.

7 Claims, 3 Drawing Figures

THERMAL PRINTER

BACKGROUND OF THE INVENTION

The present invention relates to a printing mechanism in a thermal printer having a planar thermal head.

Thermal printers include a thermal head having heating elements selectively heated to melt ink on an ink donor ribbon and to apply the melted ink to a sheet of print paper for thereby forming a desired image on a print sheet. The conventional thermal printers are classified into two printer types. One of these printer types is a serial-type thermal printer having a thermal head composed of 9, 18 or 24 vertical dots, the thermal head being transversely movable in increments to print data on a sheet of print paper. The other printer type is known as a line-type thermal printer in which a line thermal head has one line of dots for printing data by feeding a sheet of print paper therepast.

The conventional serial-type thermal printer capable of color printing includes an ink donor ribbon of multiple colors movable in plural strokes in the direction in which the thermal head traverses the sheet. Each time the ink donor ribbon is moved in its stroke, the thermal head selectively heats and melts the ink donor ribbon partially to print a multiple-color image on the sheet.

To effect such a printing operation, the serial-type thermal printer has a mechanism for enabling the thermal head, the ink donor ribbon and the print sheet to move relatively to each other in plural strokes.

Such relative movement however tends to give rise to friction due to sliding engagement between the thin ink donor ribbon which has a thickness ranging from 3 to 10 microns and the thermal head. The ink donor ribbon is therefore liable to wrinkle, be broken, or elongated.

For color printing, the thermal head and the print paper must be positionally controlled with respect to each other in their relative movement in repeated strokes, since such positional control is directly related to the accuracy of combining color images printed in different colors dependent on the dot density of the thermal head or the resolution of a printed image. It has been highly difficult to obtain the desired accuracy of such positional control.

Conventional efforts to achieve the desired positional control accuracy include a mechanism for accurately feeding the thermal head and members for transmitting movement from the feeding mechanism to the thermal head, drive motor control and feedback control, precise diameters of various feed rollers employed to feed the print paper, and a correcting mechanism to guard against a skew of the ink donor ribbon.

Therefore, in order to determine the relative positions of the thermal head and the print paper, the prior thermal printers have to meet the specified tolerances of the various mechanisms, parts, and their movements, which are quite difficult to achieve. The conventional thermal printers are therefore complex in construction.

The conventional thermal printers are also disadvantageous in that they have no effective means for preventing the ink donor ribbon from wrinkling, tearing, and elongating due to the relative frictional movement of the ink donor ribbon and the thermal head.

Examples of prior art thermal printers are disclosed in Japanese Laid-Open Patent Publication No. 57-84871 published on May 27, 1982 and Japanese Laid-Open Patent Publication No. 58-20482 published on Feb. 5, 1983.

SUMMARY OF THE INVENTION

In view of the difficulties of the prior art, it is an object of the present invention to provide a thermal printer having a simple printing mechanism composed of a fixed planar thermal head having an area covering one page, a unitary ink donor ribbon assembly, and a unitary print paper storage assembly, so that the ink donor ribbon and the print paper can easily be positioned with respect to the planar thermal head.

According to the present invention, there is provided a thermal printer including a planar thermal head composed of heating elements disposed in an area corresponding to one page, a unitary ink donor ribbon assembly including a frame and an ink donor ribbon movably disposed in the frame and having a plurality of color zones, the ink donor ribbon being positioned in confronting relation to the planar thermal head, a unitary print paper storage assembly composed of a paper cartridge and print paper stored therein, and including a presser for holding the print paper in contact with the ink donor ribbon in a printing mode and for keeping the print paper out of contact with the ink donor ribbon in a non-printing mode, and a control unit for holding the planar thermal head and the print paper against relative movement until one-page printing is effected on the print paper. The planar thermal head is fixed, and the unitary ink donor ribbon assembly and the unitary print paper storage assembly are detachable with respect to the fixed planar thermal head. Since the planar thermal head and the print paper are in fixed positions with respect to each other in the printing mode, they can easily be controlled in position with respect to each other. The unitary assemblies serve to simplify the construction of the thermal printer.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
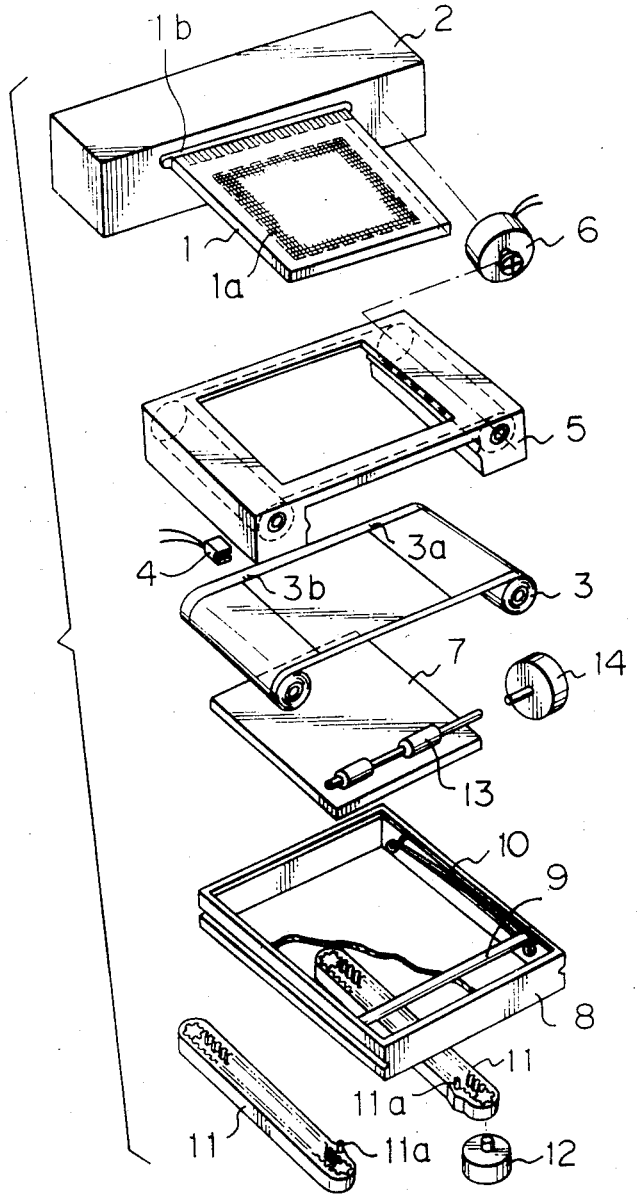
FIG. 1 is an exploded perspective view of a thermal printer according to a first embodiment of the present invention.
Figure 2:
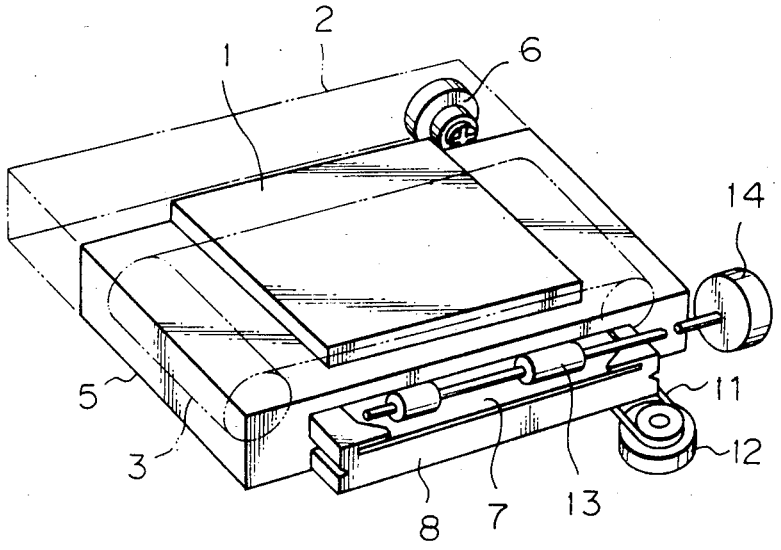
FIG. 2 is a perspective view, partly shown in phantom, of the thermal printer of FIG. 1 as assembled.

As shown in FIGS. 1 and 2, a thermal printer according to a first embodiment of the present invention includes a planar thermal head 1 composed of heating elements arranged in an area corresponding to one page of a sheet of print paper, the planar thermal head 1 having a heat applying lower surface 1*a* and a connector 1*b*. A control unit 2 connected to the connector 1*b* contains a memory, a driver, a microcomputer, and other components for controlling the heat applying surface 1*a* of the planar thermal head 1 and also the overall thermal printer.

A rolled ink donor ribbon 3 has a width corresponding to one page of the print paper and is composed of a plurality of color bands indicated by respective marks 3*a* , 3*b* that can be detected by a detector 4. The ink donor ribbon 3 and the detector 4 are housed in a ribbon frame 5. A motor 6 is also housed in the control unit 2 for driving the ink donor ribbon 3. The rolled ink donor ribbon 3 is thus disposed in a unitary assembly.

A stack 7 of separate sheets of print paper each cut to one page is accommodated in a paper cartridge 8 including a presser roller 9 disposed at the bottom of the paper cartridge 8. The pressure roller 9 is biased by a bow-shaped spring 10 for pressing the sheet stack 7. A pair of drive belts 11 is rotatably mounted on the bottom of the paper cartridge 8, the drive belts 11 having pins 11*a* engaging ends of the presser roller 9. Both drive belts 11 are driven by a motor 12.

A pair of paper feed rollers 13 is held against the upper surface of an end of the sheet stack 7 housed in the paper cartridge 8, the paper feed rollers 13 being rotated by a motor 14. The print sheets are therefore disposed in a unitary print sheet storage assembly.

Therefore, the planar thermal head 1 and the paper cartridge 8 housing the sheet stack 7 are fixedly positioned with respect to each other. The unitary assemblies or units can easily be detached from the thermal printer.

Operation of the thermal printer of the first embodiment thus constructed is as follows:

The control unit 2 depresses the pressure roller 9 with a release mechanism, not shown, to keep the sheet stack 7 out of contact with the rolled ink donor ribbon 3. Therefore, the rolled ink donor ribbon 3 can freely move with respect to the planar thermal head 1 and the sheet stack 7. The thermal printer is therefore in a non-printing mode.

Then, the control unit 2 energizes the motor 6 to rotate so as to feed the rolled ink donor ribbon 3, and selects a yellow-ink zone upon detection of the mark 3*a* with the detector 4, whereupon the rolled ink donor ribbon 3 is stopped.

The control unit 2 inactivates the non-illustrated release mechanism to allow the bow-shaped spring 10 to act on the pressure roller 9 for moving the same upwardly. The pressure roller 9 thus displaced upwardly presses the bottom of the end of the sheet stack 7 upwardly until the upper surface of the sheet stack 7 is held against the rolled ink donor ribbon 3.

Thereafter, the control unit 2 energizes the motor 12 to move the drive belts 11. The pressure roller 9 is driven by the drive belts 11 to move from one end to the other of the sheet stack 7 while being held against the bottom thereof. Therefore, the upper surface of the sheet stack 7 is held against the rolled ink donor ribbon 3 at the one-line position which moves from one end to the other of the sheet stack 7.

Simultaneously, the control unit 2 selectively energizes the heating elements on the heat-applying surface 1*a* of the planar thermal head 1 according to the yellow printing data, the energized heating elements being in the one-line position where the sheet stack 7 and the rolled ink donor ribbon 3 are held against each other. The yellow ink on the rolled ink donor ribbon 3 is partly melted and transferred to the sheet 7.

One line of data is now printed. The above printing cycle is repeated while the pressure roller 9 is moved successively through the lines over the sheet 7 until the desired characters are printed in yellow over the full page.

Then, the rolled ink donor ribbon 3 is moved to select a blue ink zone and place the same in confronting relation to the planar thermal head 1. Thereafter, the pressure roller 9 is moved while at at the same time selected heating elements are energized according to blue printing data. Thus, the desired characters or image are printed in blue over the full page of the sheet 7.

Likewise, desired characters or image are printed in red. The full page of the sheet 7 is now printed in all of the colors. The feed rollers 13 are rotated by the motor 14 to discharge the printed sheet 7 out of the thermal printer.

Figure 3:
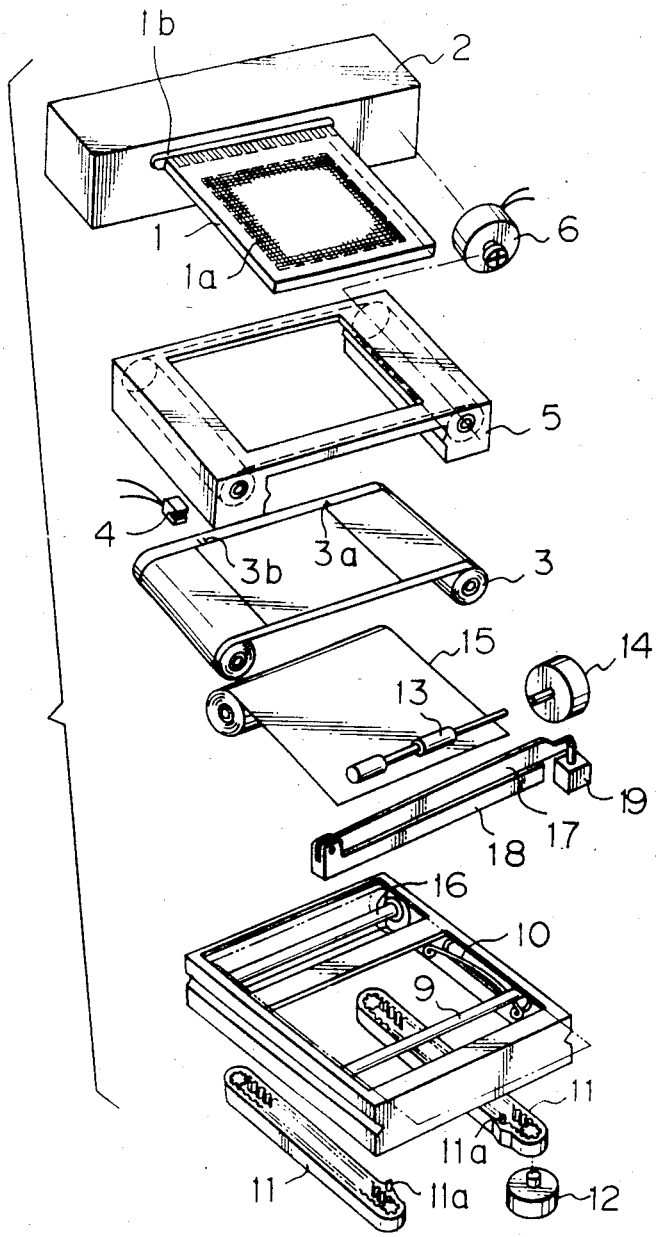
FIG. 3 is an exploded perspective view of a thermal printer according to a second embodiment of the present invention.

While the separate sheets 7 are employed in the thermal printer of the first embodiment, roll paper can also be employed. A thermal printer, shown in FIG. 3, according to a second embodiment of the present invention is designed for use with such roll paper. Like or corresponding parts shown in FIG. 3 are denoted by like or corresponding reference characters in FIGS. 1 and 2, and will not be described in detail.

Designated at numeral 15 is a roll of print paper. A roll core 16 is disposed at an end of the paper cartridge 8 for supporting the roll 15 thereon. Also provided are a paper cutter 17, a base 18 of the paper cutter 17, and a magnet 19 for moving the paper cutter 17.

The roll 15 is mounted in the paper cartridge 8, and has its end extending over the pressure roller 9 and between the paper cutter 17 and its base 18 out of the thermal printer. The thermal printer of FIG. 3 operates in the same manner as the thermal printer of the first embodiment for printing characters in colors on one page of the roll paper 15.

After the color characters have been printed, the motor 14 rotates the paper feed rollers 13 to discharge a one-page length of the roll paper 15. Then, the magnet 19 is activated to pull the paper cutter 17 toward the base 18 to cut off the one-page length of the roll paper 15 thereon.

With the arrangement of the present invention, the planar thermal head and the print paper are set a fixed positions with respect to each other during a cycle of printing operation. Therefore, they can be positioned with a desired accuracy more easily and accurately than possible with the conventional thermal printers, thus preventing color shifts or mixtures on printed sheets. With the print paper pressed against the ink donor ribbon, the ink can be transferred from the ink donor ribbon to the print paper with high efficiency to thereby improve the printing quality.

Since the ink donor ribbon moves while it is out of contact with the planar thermal head and the print paper, the ink donor ribbon is protected from wrinkles, breakage, or elongation, and can be moved stably.

The unitary ink donor ribbon assembly and the unitary print paper storage assembly are effective in simplifying the thermal printer in construction. The ink donor ribbon and the print paper can easily be replaced simply by detaching their units from the thermal printer.

Although certain preferred embodiments have been shown and described, it should be understood that many changes and modifications may be made therein without departing from the scope of the appended claims.

What is claimed is:

1. A thermal printer comprising:

a planar thermal head having heating elements disposed in a planar area to cover one entire page of print paper to be printed upon;

a unitary ink donor ribbon assembly including a frame and an ink donor ribbon movably disposed in said frame and having a plurality of color zones, each having an area corresponding to the one entire page of print paper, said ink donor ribbon being at least as wide and positioned in confronting relation to said planar thermal head;

a unitary print paper storage assembly including a paper cartridge for holding print paper to be stored therein, said cartridge including presser means for holding one page of print paper to be printed upon and in contact with said ink donor ribbon in a printing mode opposite said planar area of said planar thermal head, and for keeping the print paper out of contact with said ink donor ribbon in a non-printing mode; and control means for holding said planar thermal head, said ink donor ribbon and the one page of print paper, to prevent relative movement thereof in said printing mode until one-page printing in one color is effected on the one page of print paper, for moving said ink donor ribbon from one color zone to another color zone only in a non-printing mode, and for holding said planar thermal head and the one page of print paper to prevent relative movement thereof in alternate printing and non-printing modes until all one-page printing is effected on the one page of print paper for each of the colors in said plurality of zones to be printed on the one page of print paper.

2. A thermal printer according to claim 1, wherein said planar thermal head is fixed in position, said unitary ink donor ribbon assembly and said unitary print paper storage assembly being detachable with respect to said fixed planar thermal head.

3. A thermal printer as in claim 1, wherein said presser means comprises means for pressing a line of the one page in contact with a line of said ink donor ribbon in said printing mode and advancing the position of line contact between the page and said ink donor ribbon across the confronting area of the page and said ink donor ribbon, said control means including means for activating successive lines of heating elements opposing the line of contact between said ink donor ribbon and the page as the position of line contact advances so as to successively print lines on the one page of print paper.

4. A thermal printer according to claim 1, wherein said paper cartridge comprises means for holding a stack of separate sheets of print paper.

5. A thermal printer according to claim 1, wherein said paper cartridge comprises means for holding a roll of continuous print paper, said printer further including a paper cutter assembly for cutting off a one-page length of the print paper after one-page printing has been effected on the print paper.

6. A thermal printer according to claim 1, wherein said presser means comprises a presser roller movably mounted in said paper cartridge for movement in a direction, and a spring disposed in said paper cartridge for biasing said presser roller to hold said print paper against said ink donor ribbon along a strip thereof, said control means comprising means for successively activating successive lines of said heating elements opposing said presser roller as said presser roller moves in said direction.

7. A thermal printer according to claim 6, wherein said control means comprises means for moving said ribbon longitudinally of its length, said presser roller extending in said longitudinal direction, said presser means comprising means for moving said presser roller in a transverse direction transverse to the longitudinal direction of movement of said ribbon across the entire planar area of said thermal head, said cartridge further comprising means for feeding the one page of print paper in said transverse direction out of said cartridge after all one-page printing is effected on the one page of print paper for each of the colors in said plurality of zones to be printed on the one-page of print paper, said means for successively activating comprising means for activating successive longitudinally extending lines of said heating elements opposing said presser roller as said presser roller moves in said transverse direction, so as to successively print a plurality of lines on the one page of print paper.

* * * * *